US007152566B2

(12) United States Patent
Matsui et al.

(10) Patent No.: US 7,152,566 B2
(45) Date of Patent: Dec. 26, 2006

(54) CYLINDER HEAD STRUCTURE

(75) Inventors: Satoshi Matsui, Aichi (JP); Toshihiko Oka, Anjyo (JP); Koichi Yoshimoto, Moriguchi (JP); Yoshinori Sakurai, Kameoka (JP); Tetsushi Nagira, Kariya (JP); Kenichi Morishima, Aichi (JP)

(73) Assignees: Mitsubishi Jidosha Engineering Kabushiki Kaisha, Okazahi (JP); Mitsubishi Jidosha Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/125,143

(22) Filed: May 10, 2005

(65) Prior Publication Data

US 2005/0252463 A1 Nov. 17, 2005

(30) Foreign Application Priority Data

May 11, 2004 (JP) ..... 2004-140629

(51) Int. Cl.
*F02F 1/10* (2006.01)
*F02F 1/36* (2006.01)

(52) U.S. Cl. ..... 123/193.5

(58) Field of Classification Search ..... 123/193.1, 123/193.3, 193.5, 657–671
See application file for complete search history.

(56) References Cited

U.S. PATENT DOCUMENTS 4,418,655 A * 12/1983 Henning ..... 123/41.82 R
4,844,030 A * 7/1989 McAvoy ..... 123/193.5
4,962,733 A * 10/1990 Cheung ..... 123/193.5
5,230,312 A * 7/1993 Baika et al. ..... 123/257

FOREIGN PATENT DOCUMENTS

JP 64-51747 A 3/1984

* cited by examiner

*Primary Examiner*—Marguerite McMahon
(74) *Attorney, Agent, or Firm*—Birch, Stewart, Kolasch & Birch, LLP

(57) ABSTRACT

The bottom surface 18 of the cylinder head 10 is formed by an intake-side bottom surface 18*a* and an exhaust-side bottom surface 18*b* on which an intake port 13 and an exhaust port 15 are formed respectively. Further, a first wall 19 formed between an intake-side water jacket 16 and the intake-side bottom surface 18*a* is larger in thickness than a second wall 20 formed between an exhaust-side water jacket 17 and the exhaust-side bottom surface 18*b*. This structure can reduce an amount of HC included in exhaust gas.

8 Claims, 4 Drawing Sheets

CYLINDER HEAD STRUCTURE

BACKGROUND OF THE INVENTION

1. Field of the Invention

The present invention relates to a cylinder block structure for an engine.

2. Description of the Related Art

As shown in accompanying drawing FIG. 3, a cylinder head 100 for a general engine includes an intake port 101 and an exhaust port 102; and as shown in accompanying drawing FIG. 4 illustrating the general cylinder head taken along the line IV—IV of FIG. 3, water jackets 103 and 104 through which coolants circulates are formed in the cylinder head 100. Coolant circulating the water jackets 103 and 104 appropriately cools the cylinder head 100 to inhibit an excessive rise the temperature of the cylinder block and thereby avoid so-called seizure.

Walls between a bottom surface 106 of the cylinder head 100 and the water jacket 103 and between the bottom surface 106 and the water jacket 104, which walls respectively have thicknesses Tin and Tex in FIG. 4, are identical in thickness (i.e., Tin=Tex) as the illustration shows, so that the cylinder head 100 can be uniformly cooled.

Japanese Utility model No. SHO 64-51747 other than a technique described with reference FIGS. 3 and 4 discloses a technique of a cylinder head having a bottom surface a part of which is smaller in thickness than the remaining part, so that the thinner part is positively cooled with the object of prevention of generating a crack on the cylinder head.

SUMMARY OF THE INVENTION

An aspect of the present invention is a cylinder head structure for an engine comprising: a cylinder head having a bottom surface formed as an upper surface of a chamber in the engine; at least one intake opening formed on the upper surface; at least one exhaust opening formed on the upper surface; a thick portion formed on an intake upper wall, which is a portion of the upper surface formed on the intake opening, so that the intake upper wall is larger in thickness than an exhaust-upper wall, which is another portion of the upper surface formed on the exhaust opening.

BRIEF DESCRIPTION OF THE DRAWINGS

The present invention will become more fully understood from the detailed description given hereinbelow and the accompanying drawings which are given by way of illustration only, and thus are not limitative of the present invention and wherein.

DESCRIPTION OF THE PREFERRED EMBODIMENTS

A cylinder head structure according to a preferred embodiment of the present invention will now be described with reference to the accompanying drawings.

Figure 1:
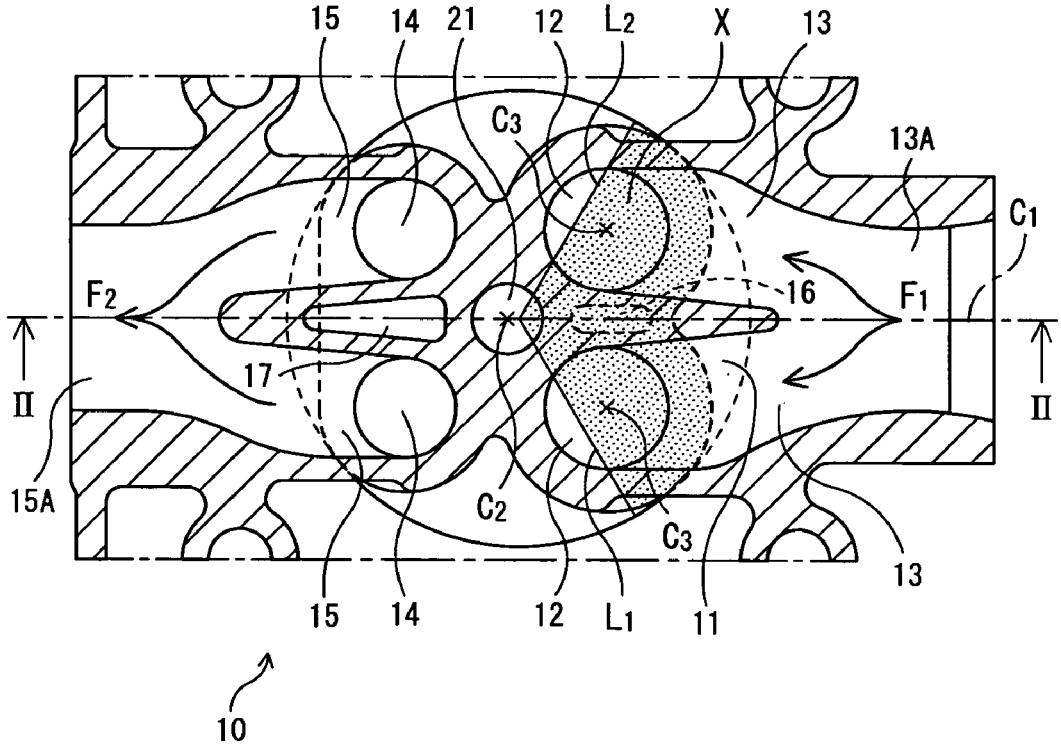
FIG. 1 is a sectional view schematically illustrating a cylinder head structure according to an embodiment of the present invention.
Figure 2:
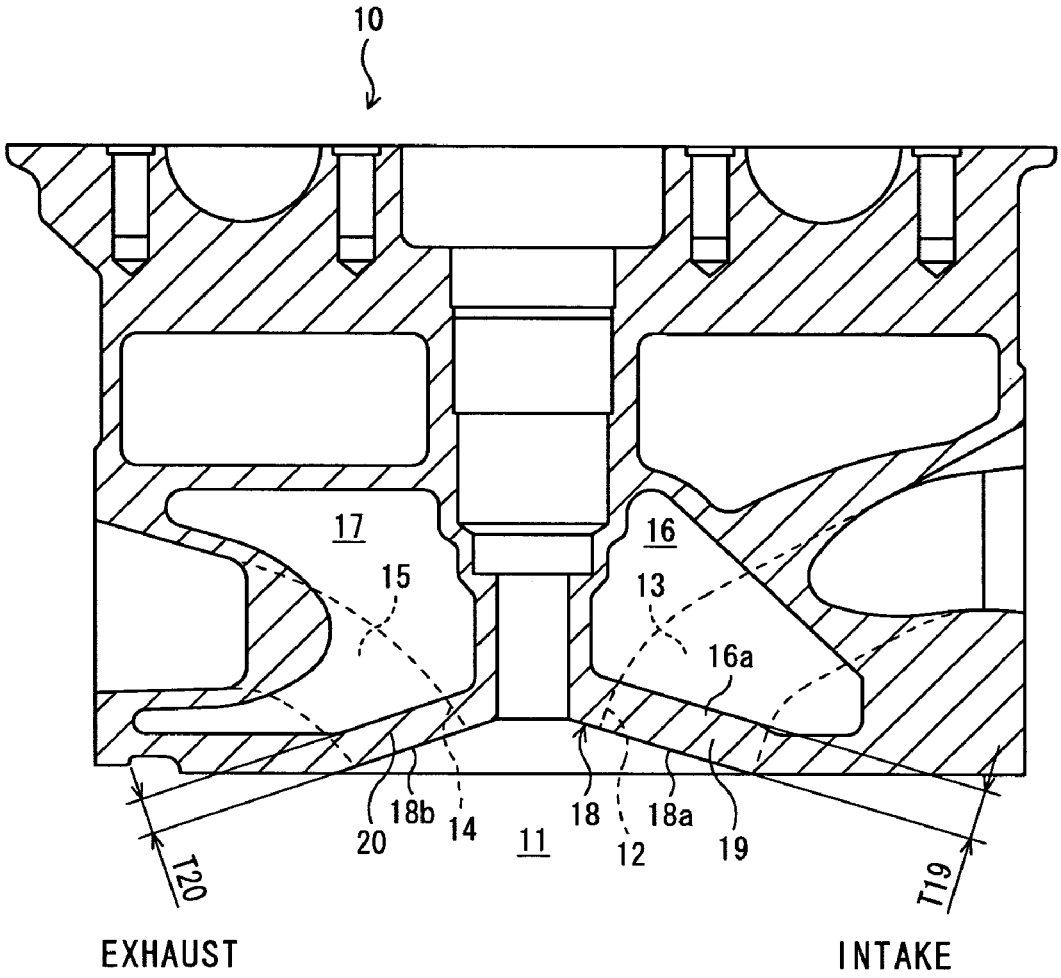
FIG. 2 is a sectional schematic view illustrating the cylinder head structure taken along the line II—II of FIG. 1.

FIGS. 1 and 2 schematically illustrate a cylinder head structure according to an embodiment of the present invention; FIG. 1 is a horizontal sectional view of the cylinder head structure and FIG. 2 is a vertical sectional view taken along the line II—II of FIG. 1.

As shown in FIGS. 1 and 2, the cylinder head 10 for an engine is arranged over a chamber 11 and includes two intake ports 13, 13, two exhaust ports 15, 15, a bottom surface 18 of the cylinder head 10. An intake-side common path 13A is arranged upstream of the intake ports 13, 13, and an exhaust-side common path 15A is arranged downstream of the exhaust ports 15, 15.

The bottom surface 18 also serves as an upper surface of the chamber 11. The surface 18 is formed by an intake-side bottom surface 18*a* and an exhaust-side bottom surface 18*b*. The intake-side bottom surface 18*a* has intake openings 12, 12 and the intake ports 13, 13. The exhaust-side bottom surface 18*b* has exhaust openings 14, 14 and the exhaust ports 15, 15.

Further, the cylinder head 10, as shown in FIG. 1, includes intake valves (not shown) and exhaust valves (not shown) respectively for opening and closing the intake openings 12, 12 and the exhaust openings 14, 14. Opening the intake valves supplies the chamber 11 with a air/fuel mixture through the intake ports 13, 13 and the intake openings 12, 12 (see arrows F1 in FIG. 1). Besides, opening the exhaust valves discharges exhaust gas from the chamber 11 to a non-illustrated exhaust system through the exhaust ports 15, 15 and the exhaust openings 14, 14 (see arrows F2 in FIG. 1).

In the plain view of the horizontal section, on the cylinder head 10, a plughole 21 is formed at a portion corresponding to the center of the chamber 11, and a non-illustrated sparking plug is installed so as to project from the plughole 21 to the chamber 11 (i.e., in a direction of the back portion of the sheet FIG. 1).

As shown in FIG. 2, an intake-side water jacket 16 and an exhaust-side water jacket 17 are formed in the vicinity of the intake ports 13, 13 and the exhaust ports 15, 15, respectively, such that coolant (cooling water) circulates through the intake-side and exhaust-side water jackets 16, 17. Further, as detailed shown in FIG. 1, a part of the intake-side water jacket 16 is formed between the intake ports 13, 13 and a part of the exhaust-side water jacket 17 is formed between the exhaust ports 15, 15.

The above-described bottom surface of the cylinder head 10 (i.e., the upper surface of the chamber 11) takes the shape of a pent-roof, and includes a first wall (an intake upper wall) 19 formed between an inner-bottom surface 16*a* of the intake-side water jacket 16 and the intake-side bottom surface 18*a* and a second wall (an exhaust upper wall) 20 formed between the exhaust water jacket 17 and the exhaust-side bottom surface 18*b*.

The first wall 19 has a thick portion (that is, a portion overlapping the hatching area X in FIG. 1) larger in thickness than the second wall 20, so that the first wall 19 also serving as a part of the chamber 11 is not excessively cooled by coolant flowing inside the intake-side water jacket 16.

In other words, the first wall 19 has the thickness thereof indicated by symbol T19 in FIG. 2 larger than that of the second wall 20 indicated by symbol T20 (i.e., T19>T20) whereby it is possible to prevent the first wall 19 from being locally excessively low in temperature. As a consequence, an amount of HC emitted from the engine can be restricted to a low level. Being exposed to exhaust gas high in temperature generated by combustion, the second wall 20 requires appropriate cooling, and the thicknesses T19 and T20 of the first and second walls of the embodiment are therefore determined so as to satisfy the relationship T19>T20.

As shown in the top view FIG. 1 (i.e., seen in the axis direction of the cylinder), the cylinder head 10 is formed such that a part of the first wall 19, which part overlaps the particular area (the hatching area in FIG. 1) X including the center axial (the center axial of the intake-side common path 13A) C1 of the intake-side common path 13A in the direction of the intake-air flow F1, is larger in thickness than the second wall 20. More specifically, the particular area X is a sector form defined in terms of two imaginary straight lines L1, L2, which are perpendicular to the center C2 of the cylinder. The two lines L1, L2 are connected to each other at an angle in the range from 90 to 130 degrees, and more preferably make an angle in the range of 120±10 degrees.

The angle is determined such that the entire wall of the chamber 11 has a substantially uniform temperature. If the angle made by the lines L1, L2 is set smaller than 90 degrees or larger than 130 degrees, the entire wall of the chamber 11 does not ensure a uniform temperature so that the amount of HC in the exhaust gas cannot be effectively reduced. Here, the angle of 130 degrees represents a angle substantially 130 degrees; the angle of 90 degrees represents an angle substantially 90 degrees; and similarly, the angle of 120±10 degrees represents an angle substantially 120±10 degrees.

The two lines L1, L2 may be set so as to pass through the cylinder center C2 and one of the centers C3, C3 of the intake openings 12, 12. If the two lines L1, L2 are set as such in the illustrated example, the two lines L1, L2 make an angle substantially 90 degrees.

The above-described cylinder head structure guarantees the following advantageous results and effects.

In the cylinder head 10, a air/fuel mixture relatively low in temperature is introduced into the chamber 11 relatively high in temperature through the intake ports 13, 13, the air/fuel mixture burns in the chamber 11 and resultant exhaust gas is discharged from the chamber 11 to the exhaust system through the exhaust ports 15, 15.

At that time, despite cooling the bottom surface 18 of the cylinder head 10 by means of coolant circulating the intake-side and exhaust-side water jackets 16, 17, the first wall 19 is less cooled than the second wall 20 because the first wall 19 is formed thicker than the second wall 20. That inhibits undue decrease in the temperatures of the intake ports 13, 13 and the non-illustrated intake valves through which air/fuel mixture low in temperature flows, and concurrently prevents the intake side of the bottom surface 18 (i.e., a part of the chamber 11) from being unduly cooled whereupon it is possible to make the temperature of the entire wall of the chamber 11 uniform.

In other words, the air/fuel mixture passing through the intake ports 13, 13 is low in temperature because the mixture in the ports 13, 13 has not burnt yet, but the exhaust gas passing through the exhaust ports 15, 15, which gas is generated by the antecedent combustion, has an extremely high temperature. For this reason, settings of a coolant flow amount and a coolant temperature so as to successfully cool the exhaust ports causes a conventional cylinder head to cool the cylinder-head bottom surface in the vicinity of the intake ports to a lower temperature than that of the cylinder-head bottom surface in the vicinity of the exhaust ports (that is, to locally cool the chamber). Therefore, the amount of HC included in exhaust gas increases.

Figure 3:
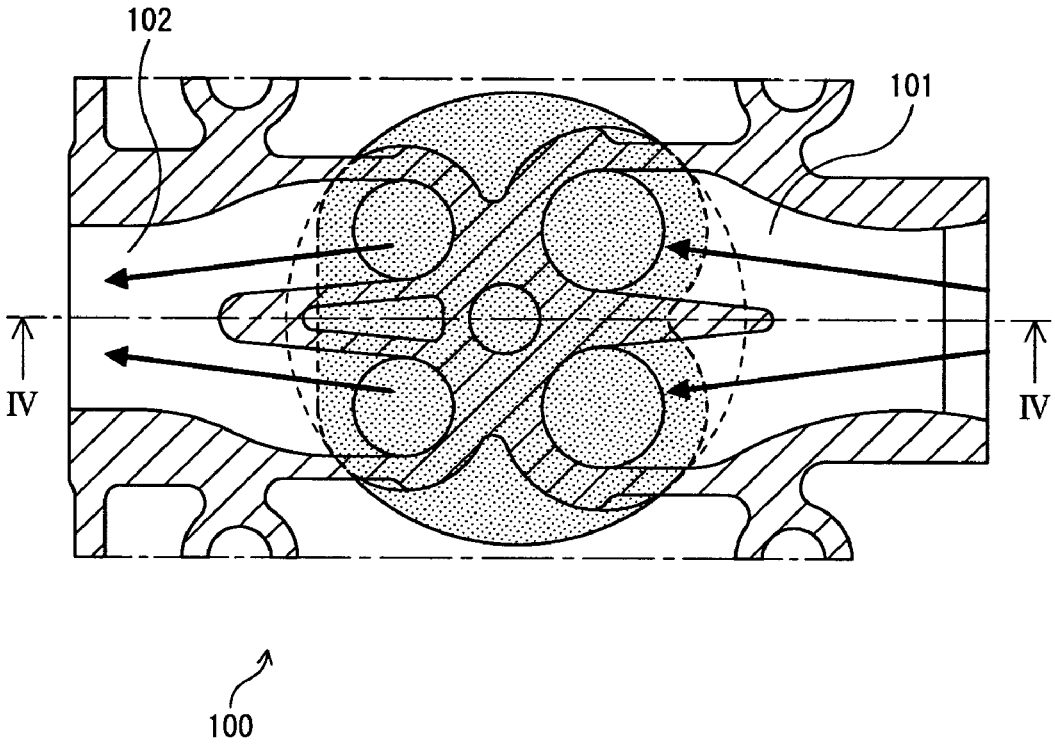
FIG.3 RELATED ART
FIG. 3 is a sectional view schematically illustrating a general cylinder head.
Figure 4:
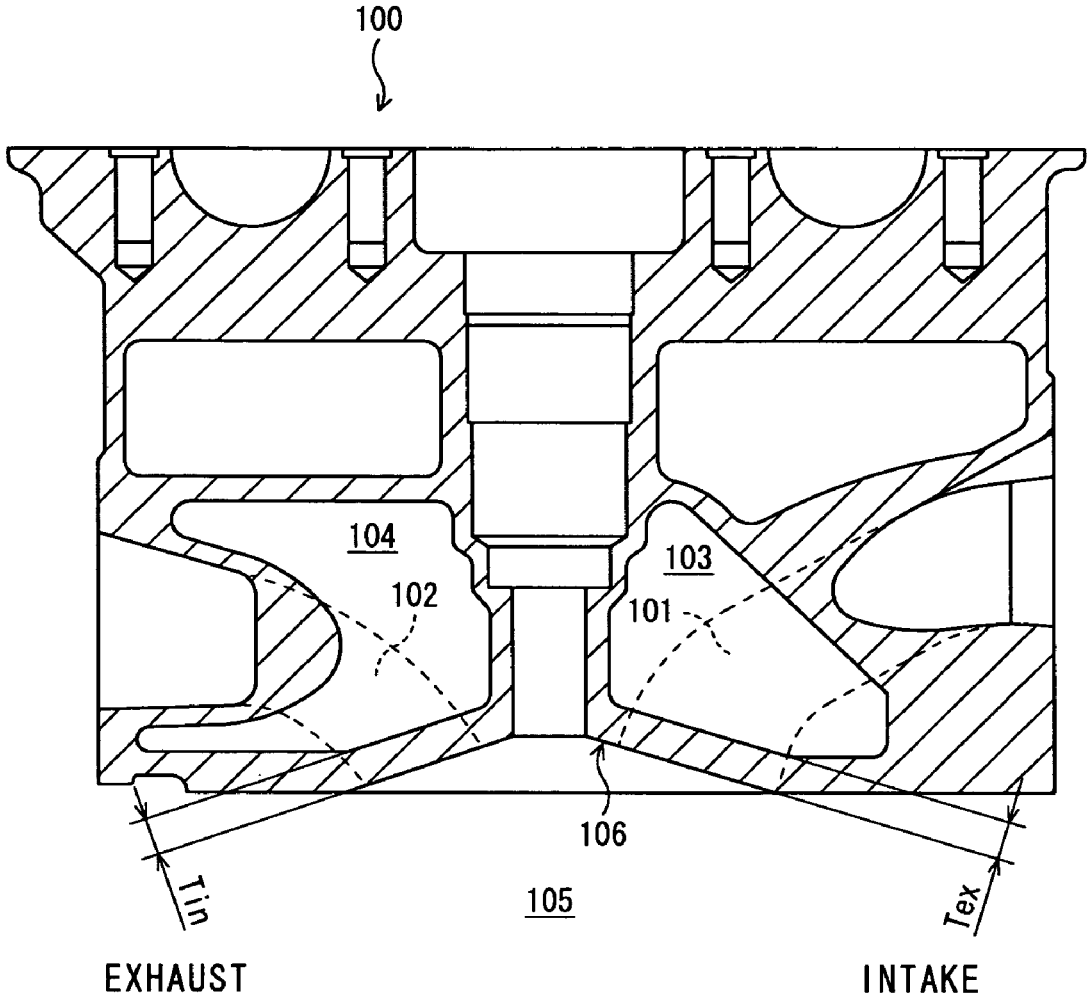
FIG.4 RELATED ART
FIG. 4 is a sectional view schematically illustrating the general cylinder head taken along the line IV—IV of FIG. 3.

Specifically, description concerning a conventional cylinder head 100 will be made with reference to FIGS. 3 and 4. Cooling capability of adequately cooling an exhaust port side 102 of a cylinder-head bottom surface 106 that reaches a high temperature cools similarly an intake side 101 of the cylinder-head bottom surface 106, and the intake side 101 of the cylinder-head bottom surface 106 is unduly cooled although the exhaust side 102 can be appropriately cooled. That results in locally low temperature of a chamber 105 and in an increase in an amount of HC in exhaust gas.

Conversely, the cylinder head 10 of the embodiment forms the first wall 19 larger in thickness than the second wall 20, so that even if settings of a flow amount and a temperature of the coolant are determined for the purpose of definitely cooling the exhaust ports 15, 15, heat in the chamber 11 is not easily transferred to the coolant circulating inside the intake-side water jacket 16, in other words, it is possible to prevent the coolant circulating inside the intake-side water jacket 16 from excessively cooling a portion of the chamber 11 and to thereby possible to reduce an amount of HC included in exhaust gas.

Further, the present invention should by no means be limited to the foregoing embodiment, and various changes or modifications may be suggested without departing from the gist of the invention.

The above description for the embodiment focuses on a single chamber 11, but the present invention can be applied to a cylinder head for an engine (i.e., a multiple cylinder engine) including a plurality of chambers.

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A cylinder head structure for an engine comprising:

a cylinder head having a bottom surface formed as an upper surface of a chamber in the engine;

at least one intake opening formed on the upper surface;

at least one exhaust opening formed on the upper surface;

a thick portion formed on an intake upper wall, which is a portion of the upper surface formed on said intake opening, so that the intake upper wall is larger in thickness than an exhaust-upper wall, which is another portion of the upper surface formed on said exhaust opening.

2. A cylinder head structure for an engine according to claim 1 further comprising:

an intake port, which is connected to said intake opening, formed in said cylinder head; and a water jacket, which is formed near said intake port and in said cylinder head, so that cooling water can be flowed therein; wherein said thick portion is a part of the intake upper wall which part is between an inner-bottom surface of said water jacket and the upper surface of the chamber.

3. A cylinder head structure for an engine according to claim 2, wherein said cylinder head has two of said intake ports, a part of said water jacket is formed between said two intake ports, said cylinder head has two of said intake openings, and said thick portion is formed in a particular area including a center of each of said two intake openings.

4. A cylinder head structure for an engine according to claim 3, wherein:

said particular area is a sector form in which two straight lines perpendicular to an axis of a cylinder in said cylinder head are connected to each other at an angle between 90 and 130 degrees.

5. A cylinder head structure for an engine according to claim 1, wherein:

said thick portion is formed in a particular area including at least one of the center of said intake opening.

6. A cylinder head structure for an engine according to claim 5, wherein:

said particular area is defined as an approximate sector form.

7. A cylinder head structure for an engine according to claim 6, wherein:

said particular area is a sector form in which two straight lines perpendicular to an axis of a cylinder in said cylinder head are connected to each other at an angle approximately between 90 and 130 degrees.

8. A cylinder head structure for an engine according to claim 6, wherein:

said particular area is sector form in which two straight lines perpendicular to an axis of a cylinder in said cylinder head are connected to each other at an angle approximately 120±10 degrees.

* * * * *